United States Patent [19]

Roy

[11] Patent Number: 4,860,492

[45] Date of Patent: Aug. 29, 1989

[54] LOUVERED BLIND STRUCTURE, MORE PARTICULARLY FOR DOUBLE-GLAZED SEALED WINDOW UNIT

[76] Inventor: Fernand Roy, 405 Vanier Street, Brossard, Canada, J4W 1Y1

[21] Appl. No.: 210,551

[22] Filed: Jun. 23, 1988

[51] Int. Cl.[4] ..... E06B 7/086

[52] U.S. Cl. ..... 49/84; 49/85; 49/87; 49/90

[58] Field of Search ..... 160/107; 98/121.2; 49/64, 84, 85, 95, 87, 90

[56] References Cited

U.S. PATENT DOCUMENTS

| | | | |
|---|---|---|---|
| 734,603 | 7/1903 | Plucker | 49/84 X |
| 1,544,326 | 6/1925 | Lelansky | 49/90 X |
| 1,937,669 | 12/1933 | Replogle | 98/121.2 X |
| 2,314,492 | 3/1943 | Guettler | 49/95 X |
| 2,558,362 | 6/1951 | Keene | 49/87 X |
| 3,210,809 | 10/1965 | Streeter, Jr. | 49/64 |
| 3,653,317 | 4/1972 | Costanzo, Jr. | 98/121.2 X |
| 3,702,040 | 11/1972 | Roy | 49/64 |
| 4,103,601 | 8/1978 | Dayus | 98/121.2 X |

*Primary Examiner*—James R. Brittain

[57] ABSTRACT

A louvered blind structure comprising a support frame, one side of which is straight and the other side not parallel to the straight side. A plurality of elongated slats are pivotally connected to the straight side at one end, and at their other end to blocks which are in turn pivotally mounted in the non-parallel side about an axis which is transverse to the longitudinal axes of the slats. An actuator structure is mounted in the straight side for simultaneously pivoting the slats between open and closed position. The louvered blind structure is adapted to be mounted within the air space of a double-glazed sealed window unit.

16 Claims, 4 Drawing Sheets

Fig. 10
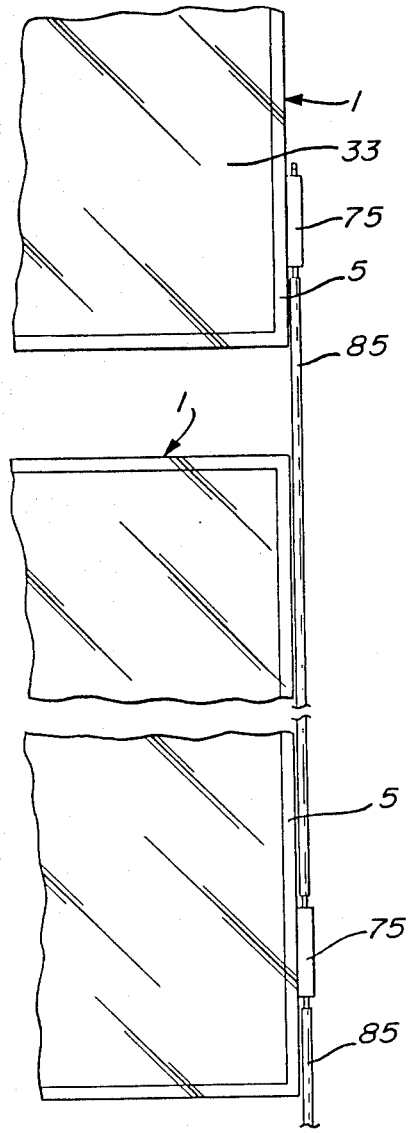
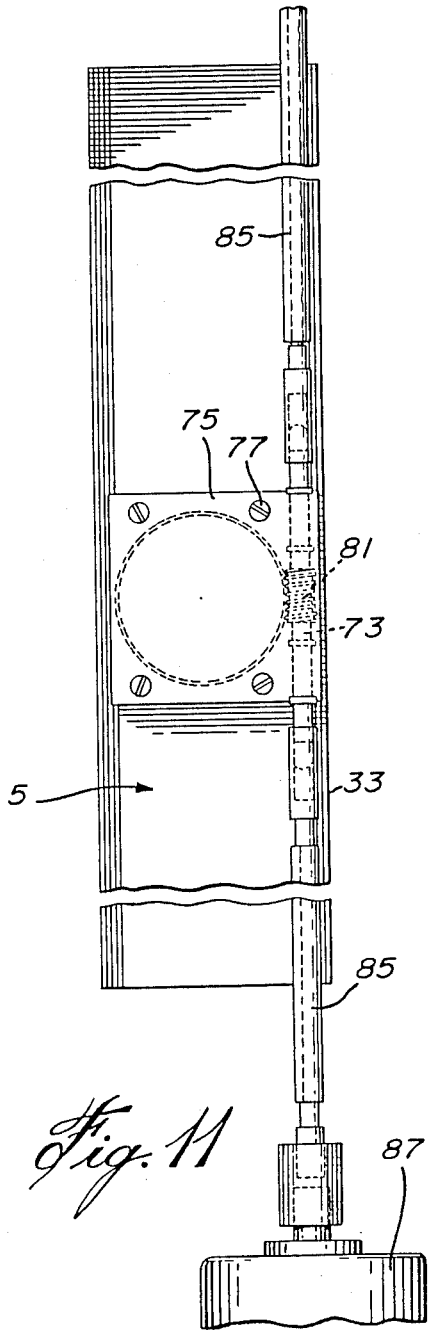
Fig. 11

LOUVERED BLIND STRUCTURE, MORE PARTICULARLY FOR DOUBLE-GLAZED SEALED WINDOW UNIT

FIELD OF THE INVENTION

The present invention relates to a lowered blind structure and, more specifically, to such a structure mounted within the sealed space of a double-glazed window unit.

BACKGROUND OF THE INVENTION

In applicant's prior U.S. Pat. No. 3,702,040 dated Nov. 7, 1972 and entitled: "VENETIAN BLIND STRUCTURE MORE PARTICULARLY FOR DOUBLE-GLAZED SEALED WINDOW UNIT", there is defined a structure of the above-described arrangement. However, the frame supporting the slats for pivoting movement must be of rectangular or square shape, the two sides of the frame supporting the pivot shafts of the slats being straight and parallel to each other. It is desirable for certain applications to provide a louvered blind structure of a non-rectangular or square shape, for instance a circular shape, a triangular or trapezoidal shape. To applicant's knowledge, no known louvered blind structures, other than square or rectangular, are available on the market.

OBJECTS OF THE PRESENT INVENTION

It is the general object of the present invention to provide a louvered blind structure in which the slats rotatable, parallel are mounted in a frame having two non-parallel sides.

Another object of the present invention is to provide a louvered blind structure of the character described, which can have a triangular, trapezoidal, oval or circular shape.

Another object of the present invention is to provide a louvered blind structure in which the slats and their actuating mechanism are totally enclosed within the sealed space of a double-glazed window unit.

SUMMARY OF THE INVENTION

The louvered blind structure of the invention comprises a frame having one straight side and an opposite side which is not parallel to the first side. The opposite side can be arcuate or straight but inclined to the straight side. A set of slats extend from the straight side to the opposite side, each slat having a first and a second pivot shaft at its opposite ends and co-axial about a first axis. The first pivot shafts are journalled in the straight side. A block for each slat in which the second pivot shaft is journalled, is pivotally mounted in said opposite side about a second axis which is transverse to the first axis. The structure further includes actuating means mounted in the straight side for drivingly interconnecting the slats for simultaneously pivoting the same between open and closed position.

The invention preferably also includes the provision of glass panes mounted on the opposite faces of the frame and forming therewith a sealed space in which the slats and the actuating means are located. Preferably, said actuating means include a sprocket gear secured to each first pivot shaft and an actuator strip guidingly mounted within the straight frame side for reciprocatory movement, said strip having a series of openings with one edge forming rack teeth meshing with said sprocket gear; and a drive shaft carrying an eccentric stud slidably engageable in a transverse slot made in the strip for reciprocating the strip upon rotation of the drive shaft. Only the drive shaft issues from the frame straight side and is sealingly journalled therein.

Preferably, each side of the frame includes an outer frame member and an inner frame member, which are slidably interconnected. The inner frame member of the frame side, which is parallel to the slats, forms a stop engageable by an adjacent slat in its open position to prevent rotation of the slat through more than 180 degrees. The inner frame member of the straight side forms an elongated housing enclosing the actuator strip and forming journals for the first pivot shafts of the slats. The inner frame member of the opposite side of the frame is of U-shape cross-section, defining a web and side legs, the side legs being substantially parallel to the glass panes and each forming guide tracks facing the other side leg, there being provided for each slat a pair of plates which are frictionally retained in the guide tracks of each leg, each block being pivoted on a pair of plates about said second axis.

BRIEF DESCRIPTION OF THE DRAWINGS

FIG. 10 is a partial plan view of several window units, the slats of which are actuated by a common motor;

FIG. 11 is an end elevation of the lower window unit, with its actuating mechanism connected to a driving motor.

DETAILED DESCRIPTION OF THE INVENTION

Figure 6:
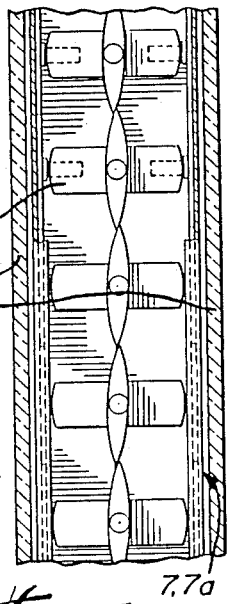
FIG. 6 is an end view of several slats looking towards their universal pivotal connection.

The louvered blind structure of the invention comprises a frame 1 in which are pivotally mounted a plurality of slats 3 arranged in spaced parallel relationship and pivoted at both ends for movement between closed and open position. In the open position, the slats 3 are generally transverse to the plane of the frame 1, and in the closed position, as shown in FIG. 6, the slats 3 are generally parallel to the frame with their longitudinal edges partially overlapping. One side 5 of the frame is straight and houses the actuating mechanism for pivoting the slats 3 at one end of the set of slats.

Figure 2:
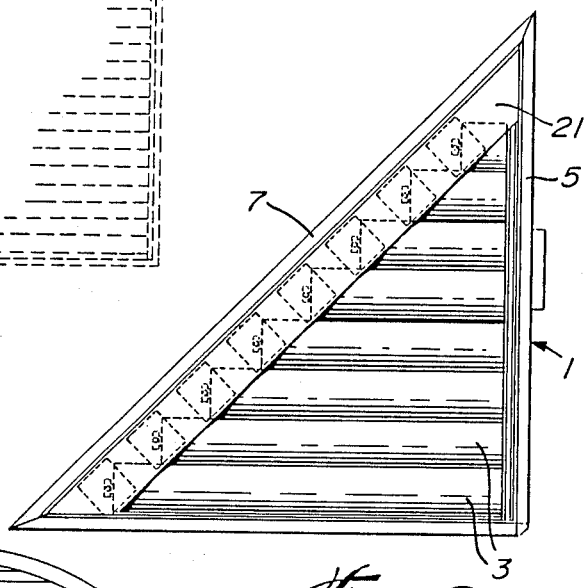
FIG. 2 is a front elevation of a triangularly-shaped louvered blind structure.

An opposite side 7 of the frame is not parallel to the straight side 5. This opposite frame side can be straight and inclined to the straight side 5, as shown in FIG. 2, in the case the entire frame forms a right triangle which could be also a trapezoidal form or other similar shapes.

Figure 3:
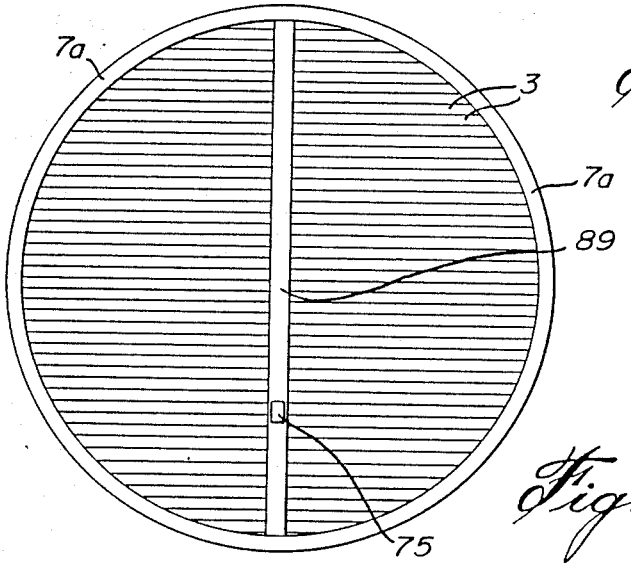
FIG. 3 is a front elevation of a circular venetian blind structure.
Figure 4:
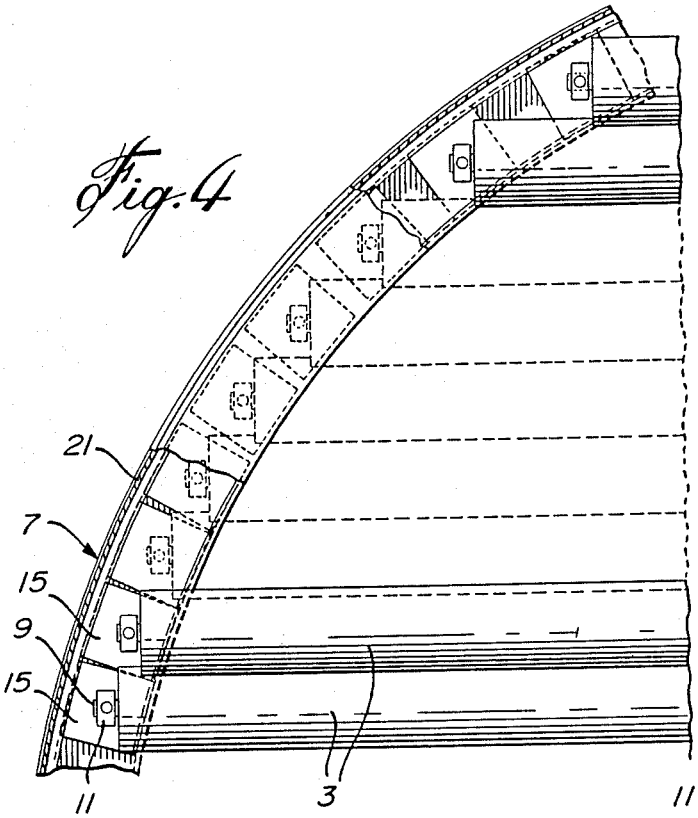
FIG. 4 is a partial front elevation of a curved louvered blind structure, partially in longitudinal section.
Figure 5:
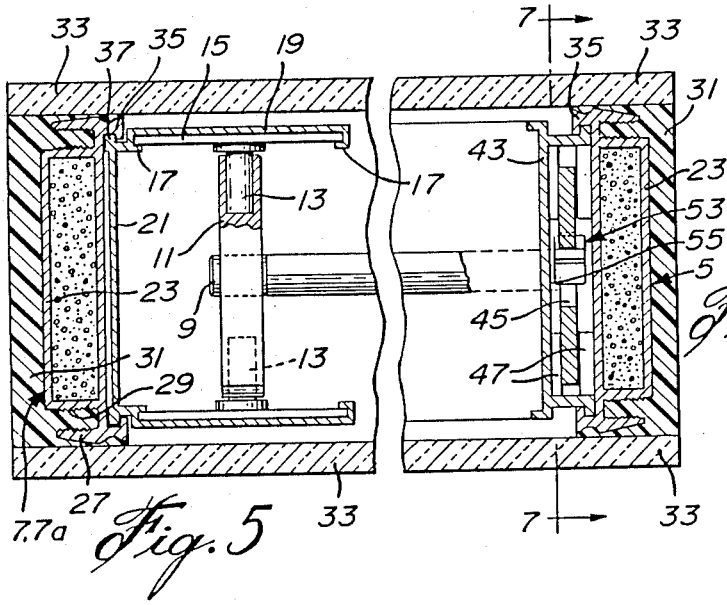
FIG. 5 is a cut-away cross-section of the curved frame and glass panes along a line parallel to the slats.

In accordance with the invention, the opposite side can also be curved, as shown at 7A in FIG. 3 and in FIG. 4. This opposite side 7 or 7A serves to pivotally support the ends of the slats 3 opposite to their driven end. At their non-driven end, each slat is provided with a pivot shaft 9, which is co-axial with the longitudinal axis of the slat and is freely pivotally mounted in a bore of a block 11, which is itself pivoted to the frame side 7 or 7A about an axis which is transverse to the axis of the pivot shaft 9, so as to form a universal pivot. More particularly, as shown in FIG. 5, block 11 has bores at its two opposite ends rotatably receiving stud shafts 13, which are each fixed to a plate 15. Each plate 15 is frictionally engaged in guide tracks 17, made at the inner face of the two legs 19 of an inner frame member 21, of U-shape cross-section. When the inner frame member 21 is longitudinally curved, as shown in FIG. 4, the pair of plates 15 of each successive slat form a small angle between themselves. However, when the inner frame member 21 is longitudinally straight, as shown in FIG. 2, the pair of plates 15 are all arranged parallel to each other. In all cases, the plates 15 are frictionally adjusted at the desired spacing, so as to maintain the several slats parallel to one another.

Figure 7:
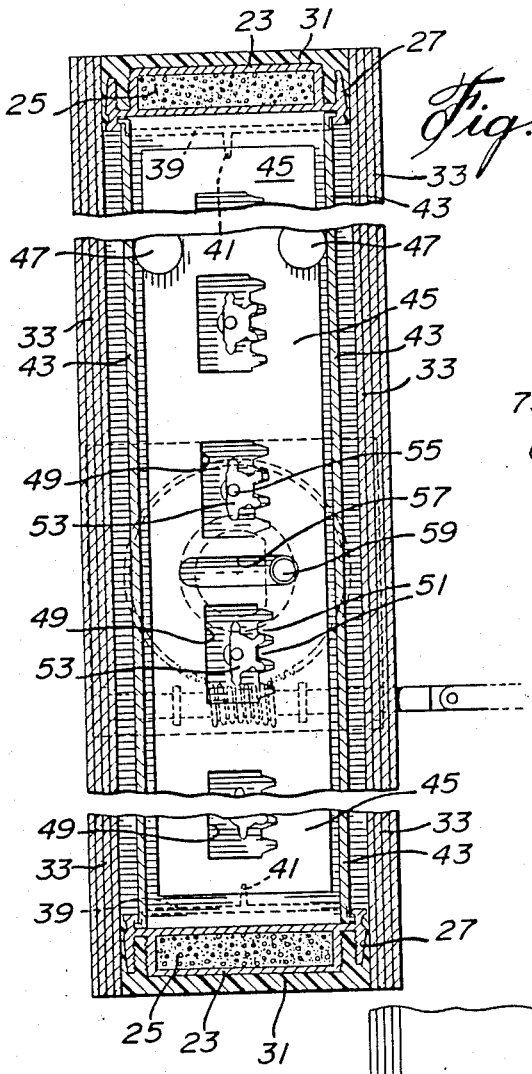
FIG. 7 is a longitudinal section taken along line 7—7 of FIG. 5 and showing the actuating mechanism for the several slats.

Frame 1 includes all around the same an outer frame member, shown at 23 in FIG. 5 and also in FIG. 7. This outer frame member is in the form of a tube of a rectangular cross-section, forming a compartment for housing a dessicant 25 in granular form.

Outer frame member 23 is provided with side legs 27 facing the ends of the central tube, the facing faces of the tube ends and of the legs being serrated, as shown at 29, to receive and retain a sealing and adhesive compound 31, such as silicone rubber, which serves to adhere to and retain glass panes 33 against the outer frame member 23 on all sides of the frame 1. Panes 33 may be solid or laminated. Thus, a closed and sealed space is defined between the two glass panes and in which the slats 3 and the pivoting mounting of the slats and the actuating mechanism for the same are located and protected against dust and the like.

Figure 1:
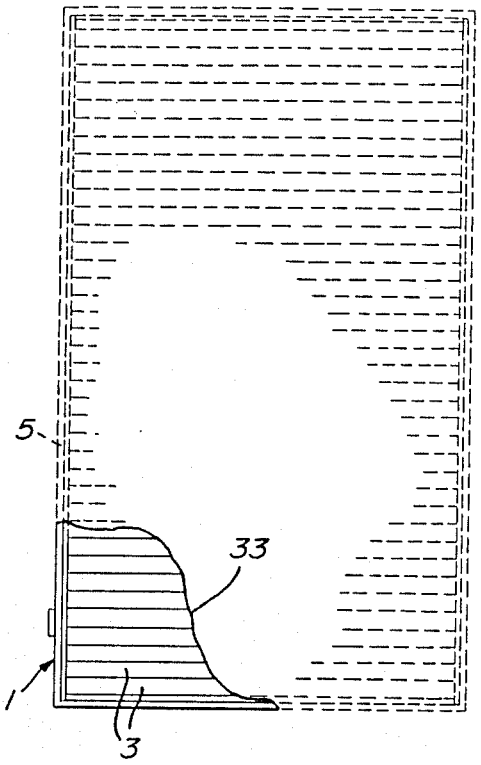
FIG. 1 is a front elevation of a rectangular window unit, a glass pane being partially shown in full line.

Each outer frame member 23 has at its inner face lateral guide tracks 35, in which are slidably fitted ribs 37 of the inner frame member 21 to retain the same. As shown in FIG. 7, those outer frame members 23, which extend parallel to the slats, for instance in the case of the top and bottom frame sides of the rectangular frame of FIG. 1, or in the case of the bottom frame side of the triangular shape frame of FIG. 2, serves to slidably retain an inner frame member in the form of a strip 39 provided with a central rib 41, which serves as an abutment or stop engaging the longitudinal edge of the adjacent slat in the open position of the latter, thus preventing rotation of the slats through more than 180 degrees. The same type of outer frame member 23, which is disposed on the actuating side of the slats, serves to retain, by its guide tracks 35, a U-shaped inner frame member 43 (see FIG. 5) which houses the actuating mechanism for the slats. This actuating mechanism comprises an actuator strip 45 mounted within the inner frame member 43 for reciprocatory movement around the same, being guided by guide pads 47 fixed to the opposite faces of inner and outer frame members 43 and 23 and applied against opposite sides of the actuator strip 45.

Actuator strip 45 is provided with a series of openings 49, of generally rectangular shape, at the level of each slat 3 and forming along one longitudinal edge rack teeth 51, which are in meshing engagement with a sprocket gear 53 fixed to the outer end of a pivot shaft 55, in turn protruding from and fixed to the slat 3, the shaft 55 being co-axial with the pixot shaft 9 at the opposite end of the slat.

Figure 8:
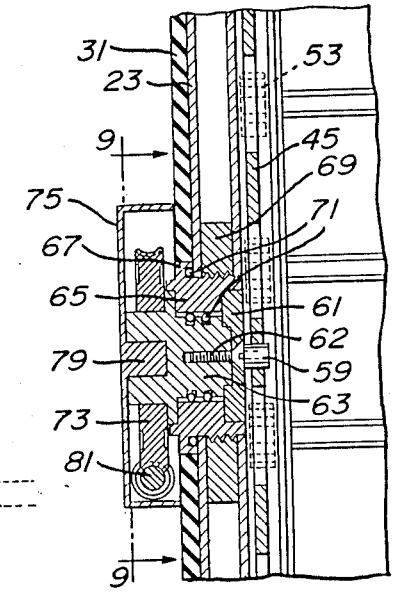
FIG. 8 is a partial cross-section of the actuating mechanism.

Pivot shaft 55 is journalled within a hole made in wall of the inner frame member 43. Therefore, reciprocating movement of the actuator strip 45 will pivot the slats simultaneously and to the same extent between open and closed position. At any suitable location along the actuator strip 45, the latter is provided with a transverse slot 57 engaged by a stud 59, which is eccentrically fixed to a disc 61 (see FIG. 8). Disc 61 is fixed by a bolt 62 to a drive shaft 63, which, together with the disc 61, is journalled within an externally-threaded bushing 65, which has an enlarged head 67 bearing against the outer face of the outer frame member 23, with its threaded portion extending through said member 23.

A nut 69, inserted within the outer member 23, is screwed on the bushing 65 to firmly retain the same in place. O-rings 71 interposed between the drive shaft 63 and the bushing 64, and between the head 67 and the frame member 23, completely seal the inner space between the glass panes.

A worm gear 73 is fixed to the outer portion of the drive shaft 63, which issues from frame 23. A casing 75 surrounds worm gear 73 and is fixed to the outer frame member 23 by screws 77 (see FIG. 11) in any one of rotated positions at right angles to each other.

Casing 75 is maintained co-axial with respect to the drive shaft 63, since it has a stud 79, of cylindrical shape, rotatably engaging a central bore made in the outer end of the drive shaft 63.

Figure 9:
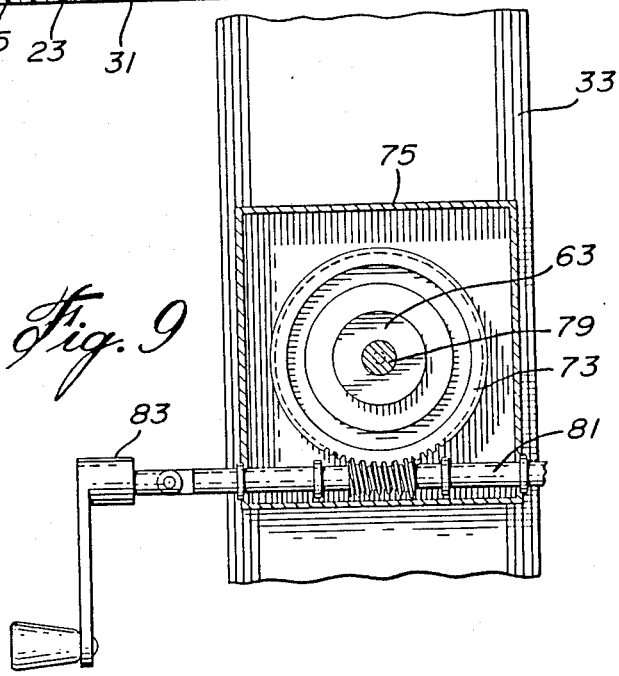
FIG. 9 is a section taken along line 9—9 of FIG. 8.

A worm shaft 81 extends transversely of the casing 75, being journalled therein, and its worm portion meshes with the worm gear 73. The worm shaft 81 can be oriented transversely of the frame side 5, as shown in FIG. 9, for rotation by a collapsible crank-handle 83, or longitudinally of the frame side 5, as shown in FIG. 11, in which case the worm shafts 81 of several window units can be serially connected by flexible shafts 85, one end of the shaft being driven by an electric motor 87, so that the latter can operate the slats of several window units simultaneously. By means of the flexible shafts 85, the slats of window units arranged in different configurations can be driven by a single motor 87.

Referring to FIG. 3, it is seen that it is possible to provide two sets of slats 3 operated by a single-actuating mechanism located in a central straight frame member 89, the actuating mechanism including an actuator strip 45, the rack teeth of which operate sprockets 53, which would be secured to the adjacent pivot shafts 55 of the aligned slats of the two sets. The outer ends of the slats of the two shafts are pivotally connected in blocks 11 mounted in the outer curved frame side 7A. It is thus possible to provide a double-glazed window unit of circular shape and housing a louvered blind structure or any other shape.

What I claim is:

1. A louvered blind structure comprising a frame having one straight side and a first opposite side, which is not parallel to said straight side, a first set of slats extending from said straight side to said opposite side, each having a first and a second pivot shaft, fixed to opposite ends of each slat, and co-axial about a first axis, said first pivot shaft of each slat journalled in said straight side, a block for each slat in which said second pivot shaft is journalled, said block pivotally mounted in said first opposite side of said frame about a second axis which is transverse to said first axis, and actuating means mounted in said straight side drivingly interconnecting said slats for simultaneously pivoting the same between open and closed position.

2. A louvered blind structure as defined in claim 1, wherein said frame defines opposite faces, each lying in a plane, the two planes being parallel and spaced from each other and defining the width of said frame, and wherein, when in open position, said slats are substantially parallel to one another and extend transverse to said planes and have a width smaller than the width of said frame; and further including a pair of glass panes sealingly secured to said opposite faces of said frame all around the same and sealingly enclosing a space in which said louvered blind structure is located, said actuating means entirely located within said space, except for a single drive shaft issuing from said frame straight side and sealingly journalled therein.

3. A louvered blind structure as defined in claim 2, further including a worm gear fixed to the outer end of said drive shaft, a casing fixed to said frame and enclosing said worm gear and a worm shaft journalled in said casing and meshing with said worm gear.

4. A louvered blind structure as defined in claim 3, further including a crank handle carried by one end of said worm shaft for rotating the same.

5. A louvered blind structure as defined in claim 3, wherein said worm shaft protrudes from opposite faces of said casing, and further including flexible shafts serially interconnecting the worm shafts of at least two louvered blind structures and one worm shaft to a driving motor.

6. A louvered blind structure as defined in claim 2, wherein said opposite side includes a member of U-shaped cross-section defining a web and side legs, said side legs substantially parallel to said glass panes, and each forming guide tracks facing the other side leg, a pair of plates frictionally retained in the guide tracks of each leg, there being a pair of plates for each slat, each block located between a pair of plates and pivotally carried thereby for pivoting about said second axis.

7. A louvered blind structure as defined in claim 6, wherein each plate carries a stud shaft pivotally inserted in a bore made in said block, said stud shaft and bore extending along said second axis.

8. A louvered blind structure as defined in claim 2, wherein said frame forms at least a portion of a right triangle with said opposite side being the hypothenuse.

9. A louvered blind structure as defined in claim 2, wherein said opposite side is arcuate and joins the two ends of said straight side.

10. A louvered blind structure as defined in claim 2, further including a second opposite side which extends from said straight side in a direction away from said first opposite side, a second set of slats extending from said straight side to said second opposite side and each having a first and a second pivot shaft fixed to opposite ends of each slat of said second set and co-axial with the longitudinal axis of the slats of said second set, the first pivot axis of the slats of said second set journalled in said straight side and an additional block for each slat of the second set in which the second pivot shaft of the latter slats is journalled, said additional blocks pivotally mounted in said second opposite side of said frame about a second axis which is transverse to said longitudinal axis of the slats of the second set, said actuating means drivingly interconnecting the slats of said second set for simultaneously pivoting the slats of the two sets between open and closed position.

11. A louvered blind structure as defined in claim 2, wherein said actuating means include a sprocket gear secured to each first pivot shaft, an actuator strip guidingly mounted within said straight side for reciprocatory movement along said straight side, said strip having a series of openings with one edge forming rack teeth meshing with said sprocket gear, said drive shaft carrying an eccentric stud slidably engaging a transverse slot made in said strip for reciprocating said strip upon rotation of said drive shaft.

12. A louvered blind structure as defined in claim 11, wherein said opposite side includes a member, of U-shape cross-section, defining a web and side legs, said side legs substantially parallel to said glass panes, and each forming guide tracks facing the other side leg, a pair of plates frictionally retained in the guide tracks of each leg, there being a pair of plates for each slat, each block located between a pair of plates and pivotally carried thereby for pivoting about said second axis.

13. A louvered blind structure as defined in claim 12, wherein each plate carries a stud shaft pivotally inserted in a bore made in said block, said stud shaft and bore extending along said second axis.

14. A louvered blind structure as defined in claim 12, wherein said frame forms at least a portion of a right triangle with said opposite side being the hypothenuse.

15. A louvered blind structure as defined in claim 12, wherein said opposite side is arcuate and joins the two ends of said straight side.

16. A louvered blind structure as defined in claim 12, wherein each side is formed of an outer frame member and of an inner frame member, which are slidably interconnected, the inner frame member of the side parallel to said slats forming a stop engageable by an adjacent slat in its open position, the inner frame member of said straight side forming an elongated housing enclosing said actuator strip and forming journals for said first pivot shafts of said slats, said frame member of U-shape cross-section being the inner frame member of said opposite side.

* * * * *